US005442978A

United States Patent [19]

Hildreth et al.

[11] Patent Number: 5,442,978

[45] Date of Patent: Aug. 22, 1995

[54] TANTALUM PRODUCTION VIA A REDUCTION OF K2TAF7, WITH DILUENT SALT, WITH REDUCING AGENT PROVIDED IN A FAST SERIES OF SLUG ADDITIONS

[75] Inventors: Richard Hildreth, Holliston; Malcolm Shaw, Medfield; Terrance B. Tripp, Westboro; Leo G. Gibbons, Littleton, all of Mass.

[73] Assignee: H. C. Starck, Inc., Newton, Mass.

[21] Appl. No.: 245,895

[22] Filed: May 19, 1994

[51] Int. Cl.[6] ..... B22F 9/00

[52] U.S. Cl. ..... 75/363

[58] Field of Search ..... 75/363

[56] References Cited

U.S. PATENT DOCUMENTS

| | | | |
|---|---|---|---|
| 2,950,185 | 8/1960 | Hellier | 75/363 |
| 4,149,876 | 4/1979 | Rerat | 75/363 |
| 4,684,399 | 8/1987 | Bergman | 75/363 |
| 4,725,312 | 2/1988 | Seon | 75/363 |

*Primary Examiner*—Peter D. Rosenberg
*Attorney, Agent, or Firm*—Jerry Cohen

[57] ABSTRACT

Fine tantalum powder of high surface area, high capacitance, low leakage and high breakdown voltage is produced by sodium reduction of highly dilute fluotantalate salt charges at high reaction temperatures and stepwise additions of the sodium reducing agent in a time-series of substantially even weight slugs added over the whole course of the reduction reaction to a melt of the charge and using the small exotherm of reduction provided by each slug as a temperature control factor.

6 Claims, 1 Drawing Sheet

TANTALUM PRODUCTION VIA A REDUCTION OF K2TAF7, WITH DILUENT SALT, WITH REDUCING AGENT PROVIDED IN A FAST SERIES OF SLUG ADDITIONS

BACKGROUND OF THE INVENTION

The present invention relates to production of capacitor grade tantalum powder of high specific capacitance, low specific leakage and high breakdown voltage.

Generally, finer powders of tantalum can be achieved when producing tantalum from fluotantalate salt sources by sodium reduction, with higher and higher dilutions of the source with NaCl and like diluents. However, the higher dilutions lead to more alkalli pick-up by the tantalum and consequently higher leakages and lower breakdown voltages.

It is a basic object of the invention to nevertheless utilize high dilution reductions in an effective way avoiding such pitfalls.

SUMMARY OF THE INVENTION

The object is achieved in a high dilution reduction conducted at high temperature—on the order of 1,000° C. This would normally be counter-indicated since higher temperatures lead to undesirable growth of newly formed tantalum grains coming out of the reduction and because the higher temperature reaction would tend to capture metals from a reactor vessel wall (typically nickel alloys) leading to higher leakage of the resultant tantalum powder. The present invention couples the higher temperature with stepwise additions of sodium reducing agent as a time-spaced series of slug subdivisions of the overall sodium feed. This overcomes the pitfalls and leads to an end product tantalum meeting the above basic object of the invention. The process can have applicability to niobium as well as tantalum reduction and to a number of salt sources, reducing agents and dilution materials used with such sources.

The invention can thus be characterized as a process for production of a target tantalum and/or niobium powder by alkali metal reduction of a charge of complex alkali metal fluo-metallic salt of said target metal(s) diluted with alkali metal-halide salt in a reaction vessel, comprising: conducting the reduction process with high rate, episodic additions of slug units of the alkali metal reducing agent to the charge, while the periodicity of reducing agent slug unit additions and the size of a slug addition are controlled in relation to charge size and reduction process temperature and mobility of the reduction mass to:

(a) utilize the reducing agent substantially completely in the reducing reaction so that residual contaminant traces of it in the isolated target metal product (Ta, Nb) are less than 10 ppm, (b) similarly reducing the capture of reduction vessel materials by reducing agent so that the residual contaminants traces of all such metals in the isolated target metal product (Ta, Nb) are less than about 50 ppm, (c) maintaining the reduction process temperature at a higher than customary level, i.e. 950°–1,100° C. for tantalum (and equivalent higher than customary reduction temperature for niobium) and more precisely in a narrow band of about 10° C. or less within such larger range substantially throughout the reduction process, utilizing the thermal energy contributed by exothermic nature of the reduction reaction, as well as supplemental heating/cooling of the reaction mass as necessary for achieving the nominal narrow selected range, but primarily relying on the episodic reducing agent addition to keep the reduction temperature within such range, and (d) establishing continuous, or regular episodes of, forced flow of the reaction mass, and consequent homogenization therein, substantially throughout the reduction process, whereby enhanced chemical, electrical and geometric properties of resultant isolated target metal powders are obtained, consistent with a production process that can be carried out at a large volume scale at high rate in a single reaction vessel.

Other objects, features and advantages will be apparent from the following detailed description of preferred embodiments taken in conjunction with the accompanying drawings in which:

DETAILED DESCRIPTION OF PREFERRED EMBODIMENTS

Figure 1:
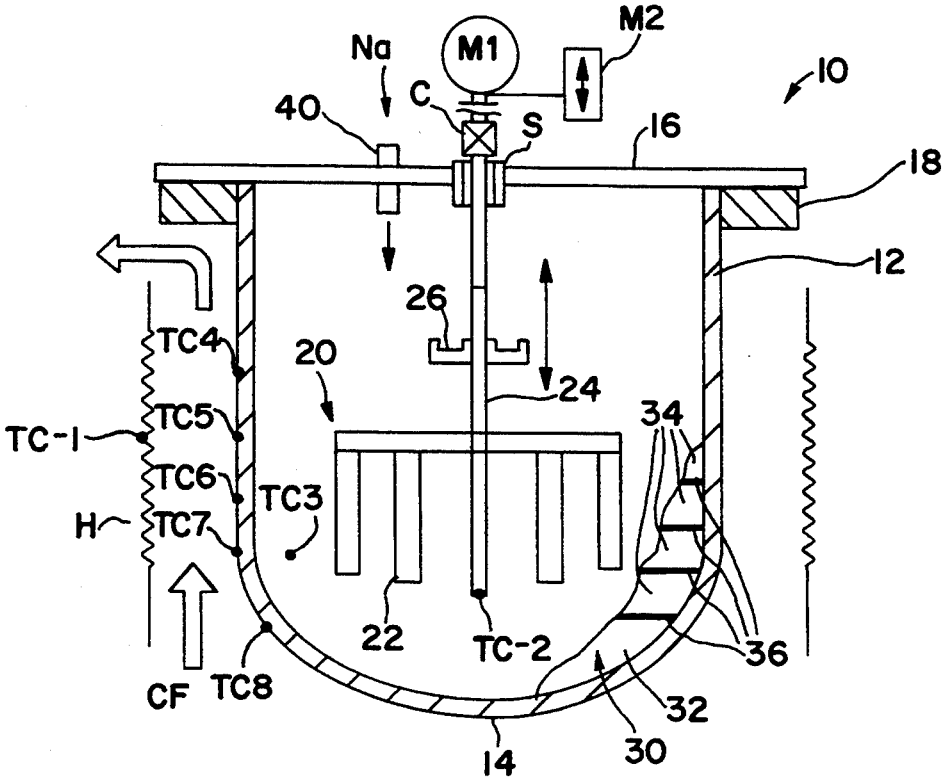
FIG. 1 is a cross-section sketch of a reactor vessel and related controls used in practice of the present invention.

The process of the invention is preferrably implemented in a vertically arrayed stirred reactor batch processor. Such a reactor 10 is shown at FIG. 1. It comprises a reactor vessel 12 with a domed bottom 14 and a reactor head 16 mounted on a flange 18 of the vessel. The vessel size is typically on the order of three to eight feet in diameter and four to eight feet in height. A stirrer 20 is provided for stirring molten charge in the vessel after its initially solid contents are melted. The stirrer can have radial, circumferential or spiral vanes 22 surrounding a central rotary shaft 24 driven by a motor M1 via a coupling C and a shaft seal S. A further motor M2 provides linear displacement of the shaft (and hence of the stirrer blades). A catcher disk intercepts spilled pieces, if any, of the seal S.

The initial charge 30 comprises a bottom layer 32 of tantalum salt source (e.g. $K_2TaF_7$) covered by interspersed thick layers 34 of diluent salt (NaCl) and thin layers 36 of fine tantalum particles. A typical charge is 660 lbs. of $K_2TaF_7$ (layer 32), four layers (34) of NaCl of 100 lbs. each and four layers 36 of tantalum fines (submicron powders) of 2.5 lb. each. The charged vessel is flushed for three to six hours with argon or other inert gas via conventional fluid handling equipment (not shown) to purge impurities, heated via external heaters H arrayed around the vessel and assisted by a convective air flow F (which also serves to implement controlled cooling) to bring about uniform, selected vessel temperature subtantially linearly tracking with heater temperatures. Thermocouples TC-1 and TC-2 are provided at the heater and on the stirrer shaft to monitor temperatures. Additional thermocouples TC-3, TC-4, etc., may be provided.

After initial purging and with the stirrer raised, the vessel is heated (and purging continues) for four to five hours at thermal energy input conditions controlled to yield a charge temperature of 975° C. The NaCl and $K_2TaF_7$ melt. The stirrer is lowered into the melt and rotation is begun. Thermal energy is adjusted to bring the charge to 980° C. Then reducing agent (sodium, Na) addition is begun via a feed-port 40 in multiple 'slug' additions, e.g. 25–35 slugs of 5.5–6.5 lbs (the last five to ten additions being below the average to limit Na distillation), each in liquid form, such addition being spread out over a period of a further one to two hours. The slugs of Na are put into the reactor in 15–20 sec. i.e., a feed rate of 900–1,000 lb./hr.

The stirrer is rotated in the melt during the entire period of Na addition. After each Na slug is added the stirrer is lowered for about one minute and then raised to the original higher level for the next slug.

As each slug hits the molten charge it goes through a reduction reaction in a matter of seconds simultaneously with dispersion because of stirring of the molten mass (and some further convective stirring therein). The reduction reaction frees tantalum chemically from the $K_2TaF_7$ and creates several byproduct salts, as is well known in the art. The reaction is exothermic and contributes thermal energy to the melt raising its temperature to 1,000° C., with adjustment by the external heating/cooling means as needed.

After completion of all Na additions and substantially full reduction of the $K_2TaF_7$ the molten mass may be held at 900° C. for another 0–2 hours, then slowly cooled to ambient, leaving a 'concrete' mass which is crushed, leached, washed and filtered in steps known in the art to isolate tantalum powders. The powders may be screened, blended and then used as primary powders for capacitance formulation or agglomerated into porous powder masses (secondary powders) by agglomeration/pre-sintering.

Primary or secondary powders can be modified by additions of other materials (e.g. phosphorous, silicon, nitrogen) at primary or secondary stages (or during the original reduction). If such additives (or compound sources thereof) are provided during reduction, it must be done in a way to avoid creating an oxidizing condition in the reactor. This can be controlled by additive species reduction (e.g. oxidizing agent compound sources being less preferred) and by timing of their addition. The powders (particularly secondary powders) can be de-oxidized by heating with magnesium or calcium reducing agents.

Testing of finished primary and secondary powder products against state of the art counterparts has shown, generally, enhanced capacitance and reduced leakage for powders made through the invention.

The practice of the invention and results obtained thereby are further illustrated by the following non-limiting Examples:

EXAMPLE 1

Six lots of tantalum powder were made using the process described above (i.e. produced by the above reduction process, agglomerated and deoxidized). The concentrations of seven impurities in these powders are summarized in Table 1. The concentration of oxygen averaged less than 1200 ppm and the carbon concentration on average is 13 ppm. The metalic concentrations are near or below the detection limit.

Carbon, sodium, potassium and high oxygen are known to degrade the electrical quality of tantalum powder. The transition metallics can cause quality problems if they are present in heterogeneous form. These results demonstrate that the process produces capacitor grade tantalum powder which has significantly improved chemical qualities.

TABLE I

| Powder Lot Number | Summary of Powder Chemistry Concentration (ppm) Oxygen | Carbon | Chromium | Iron | Nickel | Sodium | Potassium |
|---|---|---|---|---|---|---|---|
| 1 | 1160 | 14 | <5 | <5 | 10 | 3 | <10 |
| 2 | 1200 | 10 | 10 | <5 | <5 | <1 | <10 |
| 4 | 1150 | 13 | <5 | <5 | <5 | 3 | <10 |
| 4 | 1150 | 12 | 14 | <5 | <5 | 1 | <10 |
| 5 | 1180 | 12 | <5 | <5 | <5 | <1 | <10 |
| 6 | 1250 | 17 | 14 | <5 | <5 | <1 | <10 |

EXAMPLE 2

Pellets containing 0.14 grams of tantalum were pressed from the powders listed in Example 1. The pellets were sintered in vacuum at 1,400° or 1,500° C. for twenty minutes. The pellets sintered at 1,400° were anodized in 0.1 V/V % phosphoric acid solution to 100 V. The 1,500° sintered pellets were anodized to 140 V. The formation temperature was 80° C., the current density was 100 mA/gm, and the formation voltage was maintained for two hours. The anodized pellets were tested for leakage two munutes after applying a voltage 70% of formation voltage. The capacitances were measured using the method well known to the art.

The electrical properties of the powders are summarized in Table II. The capacitance is significantly higher than achieved with traditional continuous slow feed reduction processes. The very low leakage current at the 1,400° C. sinter and 140 V formation reflect the excellent chemistry of the powders.

TABLE II

| Powder Lot Number | Summary of Electrical Properties 1400° Sinter Capacitance (μF · V/g) | Leakage (nA/μF · V) | 1500° Sinter Capacitance (μF · V/g) | Leakage (nA/μF · V) |
|---|---|---|---|---|
| 1 | 20,300 | 0.20 | 14,900 | 0.22 |
| 2 | 20,700 | 0.13 | 15,700 | 0.22 |
| 3 | 20,100 | 0.22 | 15,800 | 0.23 |
| 4 | 19,700 | 0.26 | 14,800 | 0.14 |
| 5 | 19,700 | 0.20 | 15,300 | 0.25 |
| 6 | 20,200 | 0.18 | 15,300 | 0.13 |

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. In a process for production of a tantalum powder by alkali metal reduction of a charge of complex alkali metal fluotantal diluted with alkali metal-halide salt in a reaction vessel, the improvement comprising:

(a) conducting the reduction process with series, episodic additions of discrete slug units of the alkali metal reducing agent to the charge, while the series periodicity of reducing agent slug unit additions and the size of a slug addition are controlled in relation to charge size and reduction process temperature and mobility of the reduction mass to utilize the reducing agent substantially completely in the reducing reaction so that residual contaminant traces of it in the isolated tantalum metal product are less than 10 ppm;

(b) maintaining the reduction process temperature 950°–1150° C. for tantalum (and equivalent higher than customary reduction temperature for niobium) and more precisely in a narrow band of about 10° C. or less within such larger range substantially throughout the reduction process, utilizing the thermal energy contributed by exothermic nature of the reduction reaction, as well as supplemental heating/cooling of the reaction mass as necessary for achieving the nominal narrow selected range, but primarily relying on the episodic reducing agent addition to keep the reduction temperature within such range; and (c) establishing continuous, or regular episodes of, forced flow of the reaction mass, and consequent homogenization therein, substantially throughout the reduction process, and wherein the reaction mass mixing is aided by a rotatable stirrer in the reaction vessel that is displaced periodically along its rotation axis to regularly stir at different locations in the reaction mass.

whereby enhanced chemical, electrical and geometric properties of resultant isolated tantalum metal powders are obtained, consistent with a production process that can be carried out at a large volume scale at high rate in a single reaction vessel.

2. Process in accordance with claim 1 wherein tantalum is the target metal, the source salt is essentially $K_2TaF_7$, the reducing agent is sodium, the diluent comprises, primarily, NaCl, and the reduction temperature range is between 1000° C. and 1100° C. (as measured directly, or at correspondingly lower temperatures at the vessel walls), mass mixing is aided by a rotatable stirrer

3. Process in accordance with claim 2 wherein the sodium utilization is between 102 and 106% (mole % relative to tantalum) of the fluorotantate salt mass and a majority of the slug units of sodium addition are each between 2 and 7% of the total sodium to be added.

4. Process in accordance with claim 3 wherein the charge and sodium reducing agent comprises amounts selected from:

(a) about 660 pounds of fluotantalate salt and about 200 pounds of reducing agent, and (b) corresponding amounts (same stoichimetric ratios) at higher and lower levels, all the foregoing in a dilution range (diluent salt to fluorotantalate salt weight ratio) from 0.4 to 1.5, the sodium feed rate being such as to effect most (as weight majority) of the complete addition in under an hour and in any event at such rate as to limit size of resultant tantalum particles to under about 2.0 FAPD.

5. Process of claim 4 wherein a Ta particle size modifying additive is added to the charge, but in such a manner and timing as to avoid creating an oxidizing condition in the reaction mass attendant upon such addition.

6. Product as made by the reduction process of claim 2 followed by subsequent separation from the reaction mass, size sorting and pre-sintering (agglomerating) steps.

* * * * *